US005711522A

United States Patent [19]

Wiggs et al.

[11] Patent Number: 5,711,522

[45] Date of Patent: Jan. 27, 1998

[54] GAME LAUNCHING MECHANISM

[75] Inventors: Christopher C. Wiggs; Christopher Joseph Crabtree Taylor, both of London, England

[73] Assignee: Origin Products Limited, London, England

[21] Appl. No.: 428,063

[22] PCT Filed: Jan. 19, 1994

[86] PCT No.: PCT/GB94/00098

§ 371 Date: Jan. 5, 1996

§ 102(e) Date: Jan. 5, 1996

[87] PCT Pub. No.: WO94/16787

PCT Pub. Date: Apr. 8, 1994

[30] Foreign Application Priority Data

Jan. 21, 1993 [GB] United Kingdom ..... 93011821

[51] Int. Cl.[6] ..... A63F 7/24

[52] U.S. Cl. ..... 273/129 S; 273/129 R; 273/118 R; 273/108.1

[58] Field of Search ..... 773/108.1, 118 R, 773/118 A, 126 R, 126 A, 128 R, 128 CS, 128 A, 179 R, 179 S, 179 T; 473/588, 589

[56] References Cited

U.S. PATENT DOCUMENTS

| | | | |
|---|---|---|---|
| 3,976,296 | 8/1976 | Smith | 273/108.1 |
| 4,065,129 | 12/1977 | Bartok . | |
| 5,044,635 | 9/1991 | Oermann | 273/127 R |

FOREIGN PATENT DOCUMENTS

| | | |
|---|---|---|
| 889537 | 12/1944 | France . |
| 9400098 | 4/1994 | WIPO . |

*Primary Examiner*—Raleigh W. Chiu
*Attorney, Agent, or Firm*—Dilworth & Barrese

[57] ABSTRACT

A projectile launching mechanism for use in a table top game such as soccer in which an impeller is mounted on a central core for coaxial movement relative thereto against a spring bias. The central core has a striker thereon operable, in use, to move downwardly when the top of the impeller is engaged to hit a ball attached to the core at a point offset from its vertical center line and launch it radially outwardly from the core. Preferably, the ball (25) is magnetized and attaches itself to a metal attractor ring on the core, but the core can be magnetized and the ball attracted thereto. A ball (6) located in the central core (1) provides mobility for the launching mechanism.

24 Claims, 3 Drawing Sheets

GAME LAUNCHING MECHANISM

BACKGROUND OF THE INVENTION

1. Field of the Invention

This invention relates to a projectile launching mechanism and more particularly but not exclusively to a mechanism which can be used in the playing pieces of a table top game to be played by two or more players.

2. Description of Related Art

Table top player games generally simulate a team game in which a ball is passed between the playing pieces with the ultimate aim of putting it into a scoring area or goal located at opposite ends of the playing area. Games of this type would be soccer, baseball, hockey, basketball etc.

Table top games simulating soccer which can be played by two people are known. In these games, a ball is passed between a number of table top playing figures in an attempt to get the ball into a goal positioned at opposite ends of the playing area.

Soccer games are also known in which the playing pieces have a movable limb which kicks the ball to create greater realism. However, the problem with playing pieces of this type is that they have to be manufactured extremely cheaply so the moving parts can only be loosely fitted together. As a result, the kicking part of the mechanism tends to be very sloppy so directional control of a ball launched by it is still not very good.

Another problem with known launching mechanisms is that they do not include means whereby a ball can attach itself readily thereto at any point around the circumference thereof or be launched therefrom in any radial direction. This can be a particular problem if the launching mechanism is used in a team game such as soccer as the ball cannot be passed between the playing pieces and picked up by them.

It is therefore an object Of the present invention to provide a launching mechanism which enables a projectile to be launched in any radial direction therefrom with improved directional and speed control.

SUMMARY OF THE INVENTION

According to the invention there is provided a projectile launching mechanism comprising a central core, an impeller mounted on said core for coaxial movement relative thereto, a striker on said impeller and projectile attachment means operable to releasably attach a projectile to the launching mechanism, the arrangement being such that when an axial force is applied to the impeller, and a projectile is attached to the launching mechanism, the striker hits the projectile from above at a location offset from its vertical centre line whereby the projectile is launched radially outwardly from the core.

Preferably the impeller is movable axially relative to the core against a bias. Conveniently the bias comprises resilient means such as a coil spring but any other form of spring means could be mounted in the central core.

Preferably the striker comprises a flange which extends radially outwardly from the core and is shaped to engage the projectile with a shearing action. In a preferred embodiment, the flange is an annular ring which means that the projectile can be launched from the central core in a radial direction from any point of attachment thereto. If however it is desired that only a limited number of angular launching trajectories is required, then the striker ring could be multi-faceted. For instance, it could be hexagonal to give six launching directions or square if four directions are required or even triangular if only three launching directions are required.

In a preferred embodiment, the central core has a base from which support means extending radially outwardly to support the core on a flat playing surface. Conveniently the core support means comprises an outwardly extending annular flange.

All the components of the launching mechanism are preferably moulded from a plastics material so that it is extremely light and easy to manufacture. To increase mobility of the launching mechanism across a playing surface, a ball can be located inside the central core.

The ball is preferably made of a heavy material such as metal. However, it can be made of a material other than metal. For instance, it could be a shell made of a plastics material filled with concrete or some other heavy material. The main object is that the ball should be heavier than the rest of the launching mechanism thereby imparting mass to it while at the same time providing means for it to roll readily over a playing surface.

The projectile attachment means preferably comprises a metal ring mounted on the exterior of the central core for cooperation with a magnetised projectile which can be a ball made of metal or a plastics material impregnated with metal particles or a plastics material containing one or more magnets. Alternatively, the projectile attachment means could be the heavy ball located in the central core.

The projectile attachment means can however comprise a hook and loop fastener, such as VELCRO® surface on the central core for cooperation with a projectile made of a material attachable to said VELCRO® surface.

Conveniently the launching mechanism includes mounting means for releasably attaching a moulding of a figure or character thereto.

Preferably the projectile is a circular ball although any shaped projectile could be used provided that it has a curved upper surface. The projectile could therefore be a puck with a flat bottom but having a radiussed peripheral edge for engagement by the striker or the launching mechanism.

A preferred projectile launching mechanism of the invention will now be described, by way of example only, with reference to the accompanying drawings in which:

DETAILED DESCRIPTION OF PREFERRED EMBODIMENTS

Figure 1:
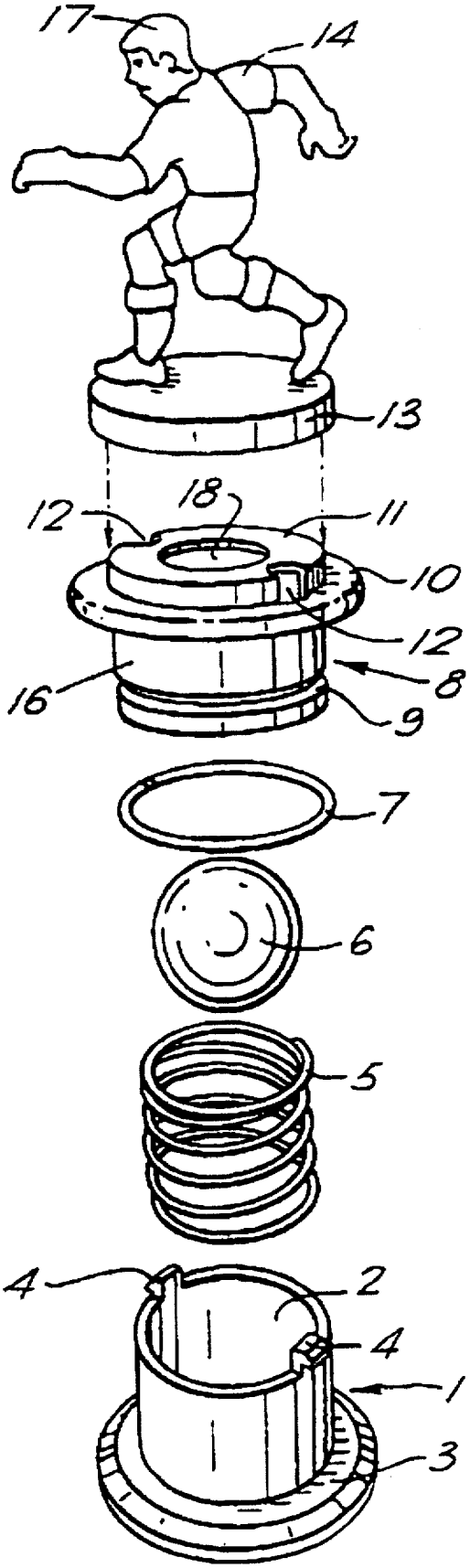
FIG. 1 is an exploded view of a launching mechanism of the invention with a figure mounted on the top thereof.

Referring to FIG. 1, there is shown a projectile launching mechanism comprising a central core 1 with a hollow tubular body 2 having stabilising means in the form of a flange 3 extending radially outwardly from the base thereof. A pair of diametrically opposed outwardly projecting hooks 4 are provided on the top edge of the tubular body 1. A radially inwardly extending lip 15 is provided around the inside region of the base of the tubular body 2 (see FIG. 2) and the bottom of a helical spring 5 seats on this annular lip 15.

A metal ball 6 is fitted inside the helical coil spring 5 and is freely axially movable therein. The inwardly directed lip 15 defines a central opening in the base of the central core 1 and the diameter of this opening is less than the diameter of the ball thereby preventing the ball from falling out of the base of the central core 1. The metal ball imparts mass to the launch mechanism and also provides means to facilitate its free rolling over the playing surface. It should be noted however that the launch mechanism slides on the base flange 3 over the playing surface rather than on the ball 6.

An impeller 8 fits over the central core 1 so as to be axially movable relative thereto against the action of the coil spring 5. The impeller has a hollow tubular body 16 with an annular rebate 9 around its base region and an outwardly extending striker 10 (an annular ring in the illustrated arrangement) adjacent its upper region. The rebate 9 receives a metal attractor ring 7 and the top of the impeller 8 is formed with mounting means 11 adapted to receive and locate thereon base 13 of a FIG. 14. The mounting means 11 has a central hole 18 therein and is also formed with a pair of diametrically opposed channels 12 adapted to receive the hooks 4 when the tubular body 16 of the impeller 8 is fitted over the tubular body 2 of the central core 1. Because the central core 1 is moulded from a resilient plastics material, the hooks 4 are deflected inwardly during assembly of the impeller 8 over the central core 1 but they then spring out laterally into the channels 12 to engage with surface 19 which forms the bottom of each channel 12 thereby limiting axial movement of the impeller 8 relative to the central core 1.

It will be seen from FIG. 1 that when the various components shown therein are assembled together, the impeller 8 can be moved downwardly relative to the central core 1 against the action of the resilient coil spring 5, the amount of axial movement being defined by the axial length of the channels 12.

Figure 2:
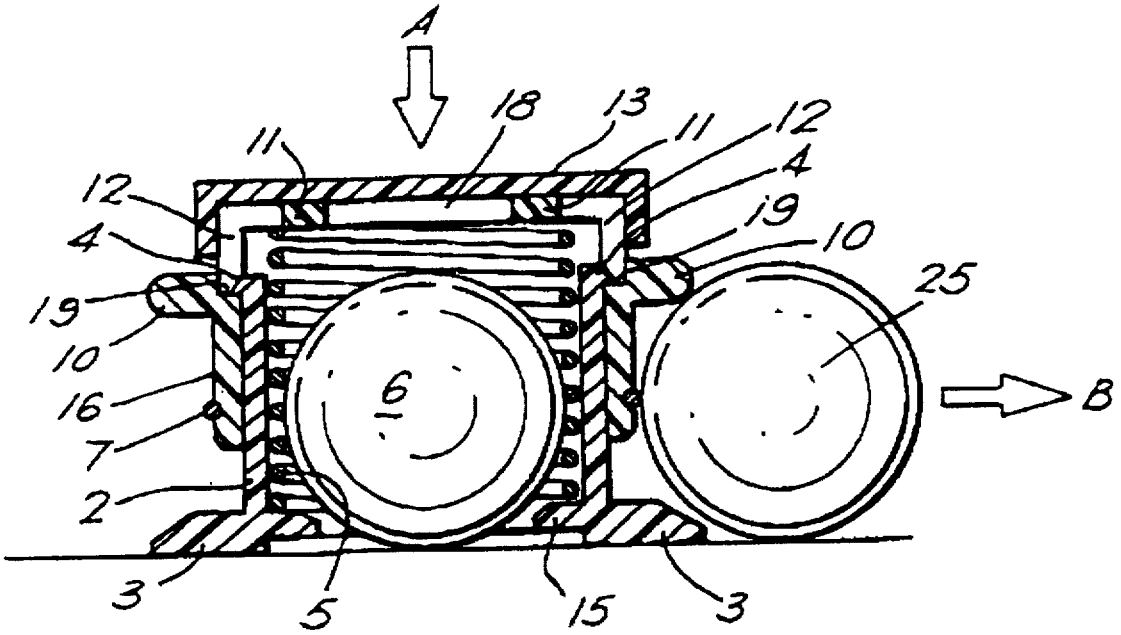
FIG. 2 is a cross section on an enlarged scale through the launching mechanism shown in FIG. 1 but with the figure omitted.
Figure 2A:
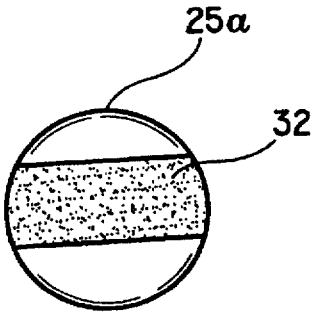
FIG. 2A is a side elevational view of an alternate embodiment of the ball shown in FIG. 2.
Figure 2B:
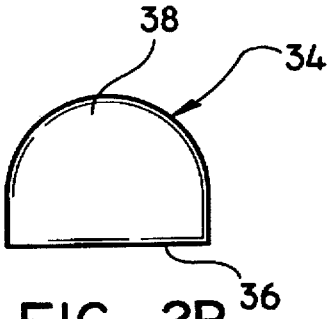
FIG. 2B is a side elevational view of a puck usable with the launching mechanism of FIG. 1.

FIG. 2 shows the way in which the projectile launching mechanism shown in FIG. I can be used to launch a ball 25 radially outwardly therefrom. It can be seen from FIG. 2 that when a downward axial force is applied to the FIG. 14 on top of the launch mechanism by tapping it smartly in the direction of arrow A, the impeller 8 will move downwardly and the striker 10 will hit the ball 25 at a location offset from its vertical central axis and launch it radially outwardly horizontally from the central core 1 in the direction of arrow B with little or no spin so its trajectory is accurate. The point of contact between the player's finger and the figure's head 17 of the FIG. 14 is small enough so that it does not allow a significant accidental rotational force to spin the ball and cause an inaccurate shot. Thus, the ball 25 is moved accurately horizontally as a result of the vertical movement of the striker 10. Furthermore, because the central core 1 is circular in configuration and the striker ring 10 is annular, the ball can be launched outwardly from the central core in any radial direction in a straight line from any point of attachment. Alternatively, a puck 34 having a flat bottom surface 36 and a curved, angled or multiplanar upper surface 38 may be substituted for the ball. See, FIG. 2*b*.

It is a feature of the preferred launching mechanism illustrated that the ball 25 is attached to it temporarily during launching and this is achieved in the illustrated arrangement by providing the metal attachment ring 7 on the impeller 8. This means that a ball can attach itself indefinitely to the core at any point around its circumference which is of considerable benefit in a team game such as soccer because it means that a player/launching mechanism can receive a pass and retain the ball thereon thereby visually indicating that the player/launching mechanism is in possession which is particularly useful when passing between players. It also enables the player/launching mechanism to move with the ball held in position at its point of attachment. Other attachment devices may also be used to attach ball 25 to the impeller 8. For example, the ball 25*a* (FIG. 2*a*) and impeller 8 may be provided with a hook and loop attachment assembly 32, such as VELCRO®.

Figure 3:
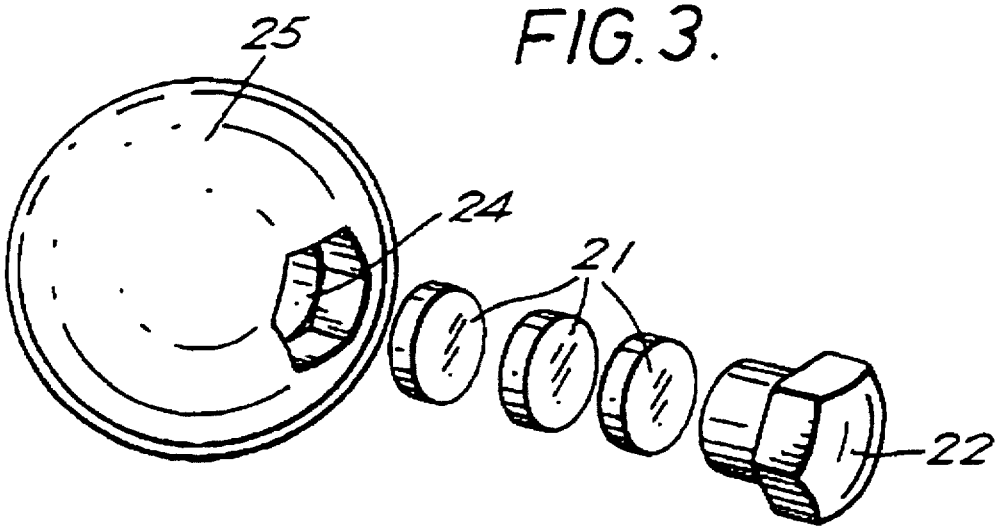
FIG. 3 is a perspective view of the projectile shown in FIG. 2.
Figure 4:
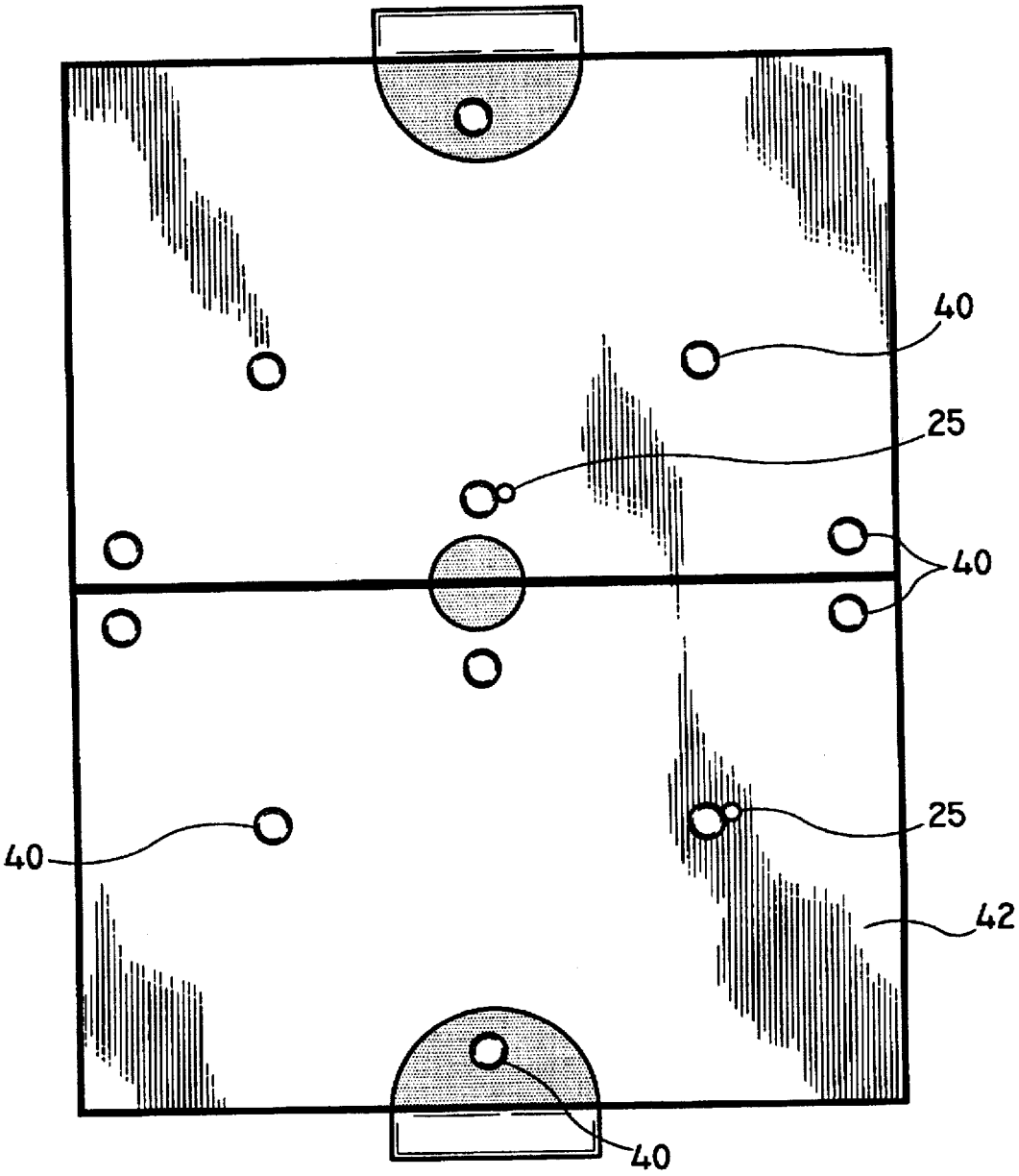
FIG. 4 illustrates a schematic view of a playing surface having a plurality of the launching mechanisms illustrated in FIG. 1.

The ball is preferably made from a plastics material with three magnets 21 (any number can be used) housed in a cavity 24 therein as shown in FIG. 3. A plug preferably made of the same material as the ball 25 is fitted into the opening 24 to retain the magnets 21 in the cavity. Thus, the ball 25 is magnetised and it will be attracted to the metal ring 7 and will attach itself to it.

Although the ball construction shown in FIG. 3 is preferred, it will be appreciated that the ball could be made in two halves with one or more magnets located therein or alternatively the plug itself can be formed as the magnet. A still further alternative is to mould the ball from a plastic material impregnated with metal particles which can then be magnetised.

An advantage of the launching mechanism of the invention is that it can be incorporated into every figure of a number of table top playing figures 40 on a tabletop football team for use on a playing surface 42 and it is simple and inexpensive to manufacture, robust enough to take the vigour of children's play and sufficiently accurate to demonstrate the skill of the player.

We claim:

1. A projectile launching mechanism comprising a central core, an impeller mounted on said core for coaxial movement, said impeller being axially depressible, a striker on said impeller and projectile attachment means operable to releasably attach indefinitely a projectile to the launching mechanism, wherein when the impeller is axially depressed, and a projectile is attached to the launching mechanism, the striker hits the projectile from above at a location offset from its vertical centre line whereby the projectile is launched radially outwardly from the core.

2. A mechanism as claimed in claim 1 wherein the impeller is movable axially relative to the core against a bias.

3. A mechanism as claimed in claim 2 wherein the bias comprises a resilient member.

4. A mechanism as claimed in claim 3 wherein the resilient means comprises a coil spring.

5. A mechanism as claimed in claim 4 wherein the coil spring is mounted within the central core.

6. A mechanism as claimed in claim 1 wherein the striker comprises a flange which extends radially outwardly from the core which is shaped to engage the projectile with a shearing action.

7. A mechanism as claimed in claim 6 wherein the flange is an annular ring.

8. A mechanism as claimed in claim 1 wherein the striker is multi-faceted.

9. A mechanism as claimed in claim 1 wherein the central core has a base from which support means extend radially outwardly to support the core on a flat playing surface.

10. A mechanism as claimed in claim 9 wherein the core support means comprises an outwardly extending annular flange.

11. A mechanism as claimed in claim 1 wherein a ball is located inside the central core.

12. A mechanism as claimed in claim 11 wherein the ball is made of a heavy material.

13. A mechanism as claimed in claim 12 wherein the ball is made of metal.

14. A mechanism as claimed in claim 13 wherein the projectile attachment means comprises the metal ball located in the central core which is itself magnetised.

15. A mechanism as claimed in claim 13 wherein the ball is magnetised.

16. A mechanism as claimed in claim 12 wherein the ball comprises a shell made of a plastics material filled with a heavy material.

17. A mechanism as claimed in claim 1 wherein the projectile attachment means comprises a metal ring mounted on the exterior of the central core for cooperation with a magnetised projectile.

18. A mechanism as claimed in claim 1 wherein the projectile attachment means comprises a hook and loop attachment assembly secured on the central core and the projectile.

19. A mechanism as claimed in claim 1 further including mounting means for releasably attaching a moulding of a figure or character thereto.

20. Apparatus for use in playing a game comprising a playing surface and a plurality of launching mechanisms, each launching mechanism comprising a central core, an impeller mounted on said core for coaxial movement, said impeller being axially depressible, a striker on said impeller and projectile attachment means operable to releasably attach a projectile to the launching mechanism, wherein when the impeller is axially depressed, and a projectile is attached to the launching mechanism, the striker hits the projectile from above at a location offset from its vertical centre line whereby the projectile is launched radially outwardly from the core.

21. Apparatus as claimed in claim 20 wherein the or each projectile is a ball.

22. Apparatus as claimed in claim 20 wherein the projectile is a puck with a flat bottom surface and an upper surface at least part of which is curved, angled or multiplanar.

23. Apparatus as claimed in claim 21 wherein the projectile is a ball made of a non-magnetic material with a magnetic material therein.

24. Apparatus as claimed in claim 20 wherein a magnetic member is provided on each launching mechanism and the projectile is made of metal.

* * * * *